United States Patent [19]

Turner

[11] Patent Number: 4,846,038

[45] Date of Patent: Jul. 11, 1989

[54] NECK STRUCTURE FOR STRINGED INSTRUMENTS

[75] Inventor: Warwick A. Turner, North Hollywood, Calif.

[73] Assignee: Gibson Guitar Corp., Nashville, Tenn.

[21] Appl. No.: 200,455

[22] Filed: May 31, 1988

[51] Int. Cl.[4] ..... G10D 1/08

[52] U.S. Cl. ..... 84/293; 84/314 R; 84/452 P

[58] Field of Search ..... 84/293, 314, 452 P

[56] References Cited

U.S. PATENT DOCUMENTS

| | | | |
|---|---|---|---|
| 501,743 | 7/1893 | Stratton | 84/314 R |
| 608,279 | 8/1898 | Benson . | |
| 647,173 | 4/1900 | Almcrantz . | |
| 1,446,758 | 2/1923 | McHugh . | |
| 1,596,763 | 8/1926 | Place, Jr. . | |
| 1,727,620 | 9/1929 | Smith | 84/314 R |
| 2,469,582 | 5/1949 | Strong | 84/293 |
| 2,597,154 | 5/1952 | Maccaferri | 84/267 |
| 3,538,807 | 11/1970 | Francis | 84/267 |
| 3,911,778 | 10/1975 | Martin | 84/267 |
| 4,084,476 | 4/1978 | Rickard | 84/293 |
| 4,119,009 | 10/1978 | Kaman | 84/293 |
| 4,121,492 | 10/1978 | Berardi et al. | 84/293 |
| 4,145,948 | 3/1979 | Turner | 84/293 |
| 4,172,405 | 10/1979 | Kaman | 84/293 |
| 4,200,023 | 4/1980 | Kaman | 84/293 |
| 4,304,277 | 12/1981 | Petillo | 144/316 |

*Primary Examiner*—Lawrence R. Franklin

*Attorney, Agent, or Firm*—Laney, Dougherty, Hessin & Beavers

[57] ABSTRACT

Improved neck structure for a stringed instrument which utilizes fiber-oriented graphite composite for formation of an elongated T-bar element that serves as the rigidifier and primary part connected between the instrument body and the peghead. The neck structure further utilizes a plurality of pin-connected frets which do not require transverse scoring or grooving of the fingerboard portion of the neck structure.

11 Claims, 2 Drawing Sheets

NECK STRUCTURE FOR STRINGED INSTRUMENTS

BACKGROUND OF THE INVENTION

1. Field of the Invention

The invention relates generally to an improved type of neck structure for a stringed instrument, viz. guitars, banjos and the like, and more particularly, but not by way of limitation, it relates to the use of a specific construction material and neck configuration design that brings about improved string response and quality of sound.

2. Description of the Prior Art

The prior art has seen a number of different types of neck structure for stringed instruments ranging from the more traditional solid wood construction through a number of different laminate and combination material structures which generally embodied certain metal structures acting in reinforcement of wood or plastics. U.S. Pat. No. 1,596,763 provides an early showing of a T-bar reinforcement construction with the metal reinforcing component used in combination with conventioal wooden parts. While the metal reinforcing bars provide a great amount of strength, they are generally unsatisfactory in terms of vibratory response. U.S. Pat. No. 4,200,023 provides teaching of another metal/wood composite structure. In this case, the stiffener component is formed from aluminum or magnesium and the resultant deleterious effects of metal are again evident. In like manner, U.S. Pat. Nos. 4,304,277; 3,911,778; 4,119,009; and 4,121,492 teach the use of a metal reinforcing bar, generally in a T or channel shape, and such reinforcing bar is used in combination with another aesthetically or tactilely more pleasing material such as wood. While the use of metal stiffening members received considerable attention, they were never considered fully satisfactory due to environmental effects and response to changes in temperature.

U.S. Pat. No. 4,084,476 provided a teaching of an elongated stiffening member formed from a laminate of strips, one of which might be formed of a composite material consisting of high modulous of elasticity filaments such as graphite or boron embedded in a resin matrix. This teaching also contemplates the use of a plurality of strengthening strips as arrayed in spaced configuration along the instrument neck. Finally, U.S. Pat. No. 4,145,948 in the name of W. A. Turner, the inventor in the present application, provides teaching of a stringed musical instrument which attempts to achieve high dimensional stiffness of the neck member through the use of graphite composite to form the neck member in a tubular shape. While this graphite composite neck provided somewhat improved tonal qualities and resistance to environmental effects, it required an inordinate amount of machining and finishing to achieve final assembly.

SUMMARY OF THE INVENTION

The present invention relates to improvements in stringed instrument neck structures which provide increased longitudinal stiffness while reducing any deleterious effects due to environmental o temperature changes. The neck structure is formed to any of various lengths and configuration using an elongated T-shaped bar formed from graphite composite as a central skeletal member, while including wood or plastic material beneath the T-shaped configuration to provide a smoothly rounded and aesthetically appealing surface to the bottom of the neck structure. Fret bars are secured along the top of the neck structure by means of at least two individual pins which are force-fit into the top surface of the neck structure. An alternative formation of the graphite composition structure also allows for inclusion of a truss rod through the length of the neck structure.

Therefore, it is an object of the present invention to provide a neck structure for a stringed instrument that has increased longitudinal stiffness.

It is still further an object of the invention to provide a guitar neck structure that is simple in construction yet contributes to improved tonal response and string vibration sustain.

It is also an object of the invention to provide a high rigidity neck structure that exhibits minimal response to environmental effects and temperature changes.

Finally, it is an object of the present invention to provide a guitar neck structure having more true tone and greater sustain while exhibiting weight and handling qualities that are comparable to prior types.

Other objects and advantages of the invention will be evident from the following detailed description when read in conjunction with the accompanying drawings which illustrate the invention.

DETAILED DESCRIPTION OF THE INVENTION

Figure 1:
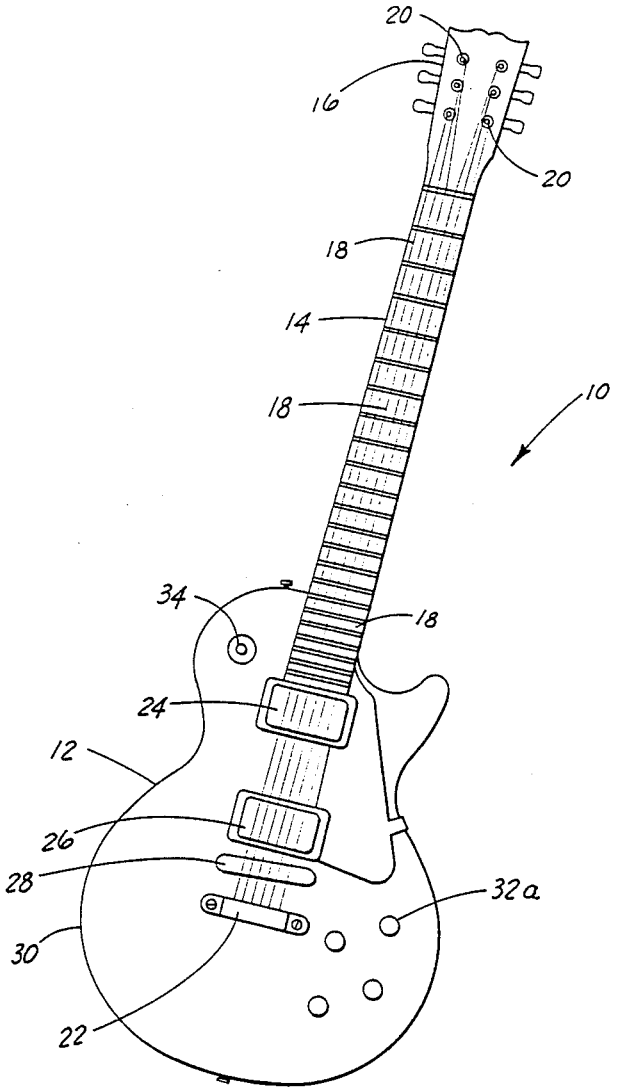
FIG. 1 is an illustration in plan view of a conventional type of guitar.

FIG. 1 illustrates a well-known form of electric guitar, a "Les Paul" ® model Gibson guitar, which is treated as representative of the general class of stringed instruments. It should be understood that this may include any number of specific instruments ranging from the mandolin and banjo through the various forms of guitar and the string bass, violin and related types. In each case these instruments may utilize the teachings of the present invention since the qualities contributed by neck structure in accordance with this writing can only benefit the final sound product.

In FIG. 1, a guitar 10 consists of a body 12, neck 14 and peghead 16 with a plurality of strings 18, in this case six such strings 18, extending between the individual crank winders 20 and a tail piece 22. Each of the strings 18 is led across a pair of electronic pickups 24 and 26 and stressed over bridge 28 for secure connection at tail piece 22. The tail piece 22 is secured centrally in the lower bout 30 of guitar body 12 and a plurality of electronic control knobs 32 and switch 34 provide player control over the electronic output.

Figure 2:
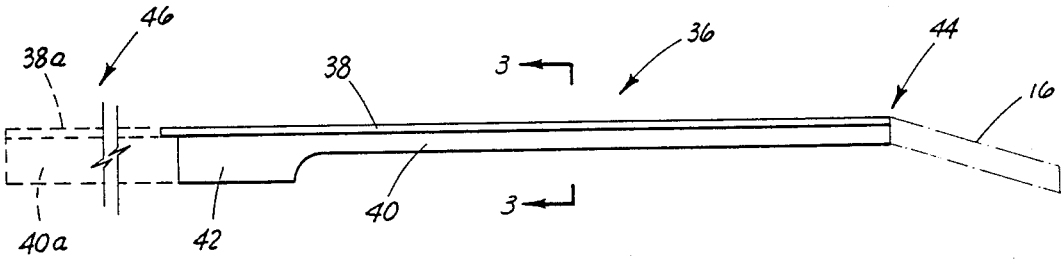
FIG. 2 is a view in side elevation with parts shown in phantom of a guitar neck structure.

Referring to FIG. 2, a T-bar 36 is the primary structural element of the guitar neck 14. The T-bar 36 consists of an elongated face bar 38 which is integrally molded with and extending a right angle bar 40 from the central, lower surface thereof. The T-bar 36 is molded from graphite composite and it provides extremely high rigidity to the guitar neck thereby to enhance the sound output, i.e., the guitar neck 14 is stiffer with less loss of energy as the strings 18 vibrate longer while giving a more true tone. The graphite composite is a known type of material formed with graphite fibers oriented with the elongated lay of the T-bar 36 as cured within a selected polymeric resin matrix material, such as an epoxy. In addition to the improved tone and sound sustain, the guitar neck 14 is less subject to environmental effects from such as temperature and humidity changes, and effects of oils and acids built up through handling.

The right angle bar 40 may be enlarged at the body end to form a tongue member 42 which provides the longitudinal central portion of the neck insert that is secured within the mating slot (not shown) in the body 30. This is a conventional type of guitar joining structure referred to as the "bolt-on" neck. It may also be desirable to form a neck pitch of from 0° to 5° at the body joint, and the peghead 16 may also be joined at an angle to T-bar 36 at the nut position 44, e.g. an angle of up to 17°.

An alternative form of stringed instrument construction may be what is termed the "neck-through" type wherein the instrument neck structure 14, in this case the T-bar 36, extends centrally all the way through the body while the body member is formed of opposite side half sections suitably bonded and secured in position. The dash line 46 illustrates such neck-through T-bar structure with extended face bar 38*a* and right angle bar 40*a*.

Figure 3:
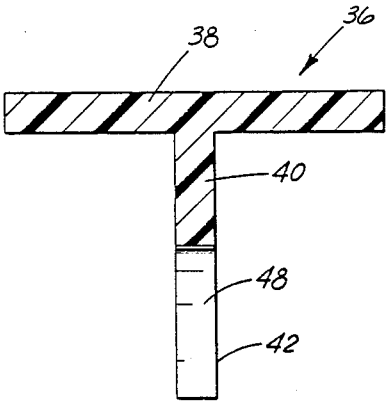
FIG. 3 is a section taken along lines 3—3 of FIG. 2.
Figure 4:
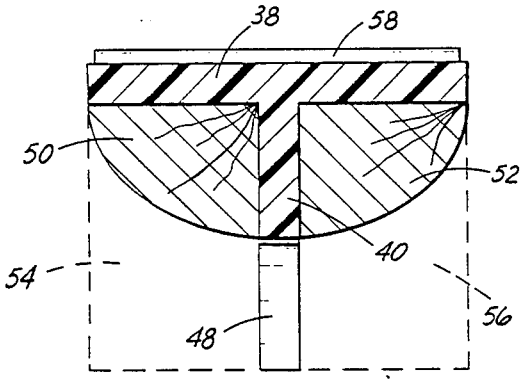
FIG. 4 is a section taken generally centrally along a guitar neck structure as constructed in accordance with the present invention.

FIG. 3 illustrates a section through the T-bar 36 illustrating face bar 38 and right angle bar 40, and showing the curving surface 48 extending down for formation of insert tongue member 42 of right angle bar 40. FIG. 4 shows a similar section when the neck structure is completed to include the generally quarter round wood inserts 50 and 52 which fill out the complete neck structure. The wood strips 50 and 52 may be suitably bonded in affixure, and dash-line structures 54, 56 denote sculptured wood structure that is present about the body/-neck joint. The joining wood structure may be variously formed in accordance with the particular style of instrument. The top surface of face bar 38 shows a transverse fret 58, a plurality of which are secured along the fingerboard or neck structure upper face in well-known manner.

The wood strips 50 and 52 are selected more for their qualities of weight and feel and the lower extremities of the neck structure are finished in selected manner to achieve the desired aesthetic effect. The underside of the neck structure will also vary from ellipsoid to semicircular depending upon the particular guitar style and-/or player preference.

Figure 5:
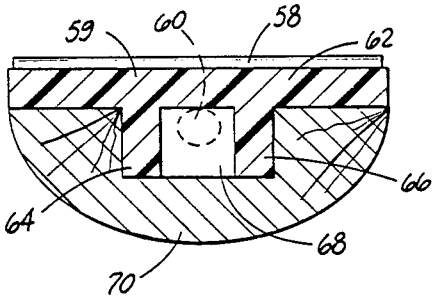
FIG. 5 is a cross-section of an alternative form of neck structure.

FIG. 5 illustrates an alternative form of T-bar 59 which also makes provision for inclusion of a truss rod 60 that allows selective tensioning and adjustment of the guitar neck structure. In this case, the graphite composite member consists of a unitary molded configuration including an elongated face bar 62 depending a pair of spaced, equal-length and longitudinally centrally disposed right angle bars 64 and 66 which define a void space 68 therebetween. The void space 68 extends the length of the T-bar 59 as truss rod 60 interconnects adjustably as anchored between the body member and the peghead. A plurality of frets 58 are secured along face bar 62 and the addendum or wooden portion 70 may be unitarily formed, affixed and finished to provide the requisite feel and aesthetic effect. While the sections of FIG. 4 and FIG. 5 show the frets secured directly on the top of the respective face bars 38, 62 thereby to form the fingerboards, it should be understood that additional separate fingerboard panels may be bonded on the face bars to receive the frets 58, and that the fingerboard surface may be arcuately formed in certain cases, as will be further described below.

Figure 6:
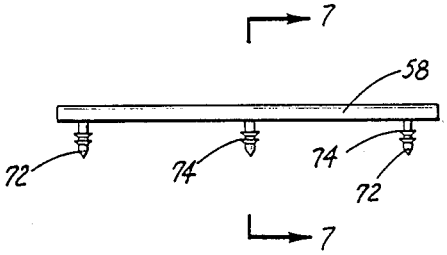
FIG. 6 is a view in elevation of a fret bar with securing pins.
Figure 7:
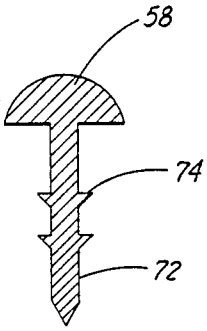
FIG. 7 is an enlarged view in section taken along lines 7—7 of FIG. 6.

FIG. 6 illustrates a fret 58, see also the section of FIG. 7, which is unitarily formed to include at least two anchor structures in the form of force-fit pins 72. The pins 72 are preferably formed with some form of ridge or interfering structure 74 disposed along their length so that they are tightly and permanently received within the face bar structure, e.g. face bar 38.

Prior types of fret structure have included a band or other elongated structure along the bottom of the fret member, and installation required the cutting of a transverse groove in the fingerboard or face bar of the neck structure with subsequent pounding of the fret and anchor bar tightly therein. Such transverse cuts obviously weaken the longitudinal rigidity of any such fingerboard or other face bar structure to a considerable degree. With frets 58 of the type shown in FIGS. 6 and 7, at least two but possibly three or more minute holes is all that need be formed whereupon the individual fret pins 72 are entered and force fit downward therein to position fret 58 transversely across the fingerboard or face bar.

Figure 8:
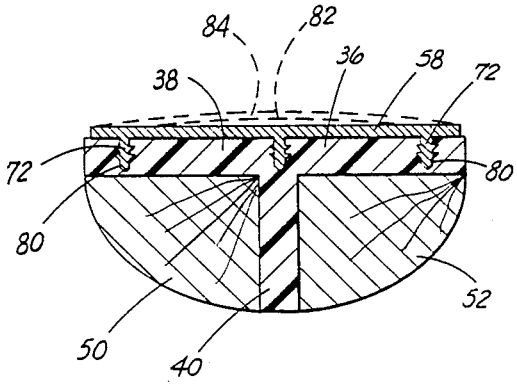
FIG. 8 is a cross-section taken through a neck structure and bisecting fret bar.

FIG. 8 illustrates a T-bar 36 such as that of FIGS. 3 and 4, showing the fret 58 affixure. Thus, two or more holes 80 are formed transversely across the face bar 38, and the irregular barrel pins 72 are force fit downwardly therein to position the fret 58.

The dash lines in FIG. 8 indicate that suitable arcuate neck facing can be achieved by preliminary molding and shaping of the basic components. Thus, the T-bar face bar 38 may be molded to have a top surface 82 of desired arcuate configuration, and the associated frets 84 would be similarly arcuate. In addition, it may be desirable to interpose a layer of selected wood or other more decorative material in overlay on face bar 38 with the frets of similar shape received thereon. In any event, the greatly rigidifying elongated T-bar structure would still be intact as secured between the body and the peghead of the instrument.

While the description of embodiments has been carried out primarily with respect to guitars and basses, it should be understood that all manner of stringed instruments of the general type can benefit from the inclusion of the graphite composite T-bar. The superior achievement in longitudinal rigidity provides a retaining structure over which strings will vibrate longer and will have truer tone. In addition, such increased rigidity is achieved with little or no additional weight and, in fact, may result in lesser weight neck structure with proper selection of the filler strips rounding out the bottom or back of the neck.

The foregoing provides teaching of an improved form of stringed instrument, especially guitars and basses, wherein improved musical performance and physical construction of instruments is achieved at little or no increase in cost or labor. The neck structure constructed in accordance with the present invention may be utilized with either bolt-on or neck-through stringed instrument construction while bringing the desirable characteristics to the instrument function in each case.

Changes may be made in combination and arrangement of elements as heretofore set forth in the specification and shown in the drawings; it being understood that changes may be made in the embodiment disclosed without departing from the spirit and scope of the invention as defined in the following claims.

What is claimed is:

1. In a stringed instrument consisting of a body, neck and peghead, the neck structure, comprising:

a T-shaped structure formed unitarily of molded graphite composite to include an elongated face bar and centrally positioned, elongated right angle member;

elongated structure formed of different material and secured to the underside of said face bar and enveloping said right angle member to define a smoothly rounded surface; and a plurality of metal fret bands disposed transversely across said face bar in predetermined spacing therealong, each fret band being anchored by at least two spaced securing pins.

2. Neck structure as set forth in claim 1 wherein said right angle member comprises:

a pair of planar bars in spaced disposition defining an elongated void space therebetween.

3. Neck structure as set forth in claim 2 wherein said molded graphite composite comprises:

graphite fibers that are pre-aligned and embedded within a polymeric resin matrix, said alignment being longitudinally along said elongated face bar and right angle member.

4. Neck structure as set forth in claim 1 wherein said molded graphite composite comprises:

graphite fibers that are pre-aligned and embedded within a polymeric resin matrix, said alignment being longitudinally along said elongated face bar and right angle member.

5. Neck structure as set forth in claim 1 wherein each of said securing pins comprises:

a round pin unitarily formed and extending from said respective fret band and having a barbed point to effect secure forced fitting in said face bar.

6. Neck structure as set forth in claim 5 wherein said molded graphite composite comprises:

graphite fibers that are pre-aligned and embedded within a polymeric resin matrix, said alignment being longitudinally along said elongated face bar and right angle member.

7. Neck structure as set forth in claim 1 wherein said right angle member comprises:

a planar bar having approximately the same thickness as said face bar.

8. Neck structure as set forth in claim 7 wherein said molded graphite composite comprises:

graphite fibers that are pre-aligned and embedded within a polymeric resin matrix, said alignment being longitudinally along said elongated face bar and right angle member.

9. Neck structure as set forth in claim 1 wherein said molded graphite composite comprises:

graphite fibers that are pre-aligned and embedded within a polymeric resin matrix, said alignment being longitudinally along said elongated face bar and right angle member.

10. A fret for transverse affixure to a guitar fingerboard, comprising:

an elongated, narrow metal strip having an upper surface and a flat lower surface; and at least two spaced securing pins extending from said lower surface for affixure in said fingerboard;

whereby said fret can be affixed without necessity for a continuous cut transversely across said fingerboard.

11. A fret as set forth in claim 10 wherein each of said securing pins comprise:

a pin barrel having a generally pointed end; and barb structure formed on said barrel to provide force-fit interference.

* * * * *